US009088076B2

(12) United States Patent
Fujita et al.

(10) Patent No.: US 9,088,076 B2
(45) Date of Patent: Jul. 21, 2015

(54) ANTENNA DEVICE

(75) Inventors: Suguru Fujita, Tokyo (JP); Ryosuke Shiozaki, Kanagawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 185 days.

(21) Appl. No.: 13/814,901

(22) PCT Filed: Feb. 6, 2012

(86) PCT No.: PCT/JP2012/000788

§ 371 (c)(1),
(2), (4) Date: Feb. 7, 2013

(87) PCT Pub. No.: WO2012/108174

PCT Pub. Date: Aug. 16, 2012

(65) Prior Publication Data

US 2013/0141290 A1 Jun. 6, 2013

(30) Foreign Application Priority Data

Feb. 10, 2011 (JP) ..... 2011-027721

(51) Int. Cl.

| | |
|---|---|
| ***H01Q 25/04*** | (2006.01) |
| ***H01Q 19/30*** | (2006.01) |
| ***H01Q 7/00*** | (2006.01) |
| ***H01Q 21/29*** | (2006.01) |
| ***H01Q 1/24*** | (2006.01) |

(52) U.S. Cl.

CPC ..... *H01Q 25/04* (2013.01); *H01Q 1/243* (2013.01); *H01Q 7/00* (2013.01); *H01Q 19/30* (2013.01); *H01Q 21/29* (2013.01)

(58) Field of Classification Search

CPC ..... H01Q 7/00; H01Q 19/30; H01Q 21/29; H01Q 25/00; H01Q 25/04

USPC ..... 343/724, 725, 726, 727, 728, 729, 741, 343/744, 811

See application file for complete search history.

(56) References Cited

U.S. PATENT DOCUMENTS

| | | | |
|---|---|---|---|
| 6,006,069 | A | 12/1999 | Langston |
| 6,101,174 | A | 8/2000 | Langston |
| 6,112,056 | A | 8/2000 | Langston |
| 6,553,239 | B1 | 4/2003 | Langston |
| 7,573,388 | B2 | 8/2009 | Khatri |

(Continued)

FOREIGN PATENT DOCUMENTS

| | | | |
|---|---|---|---|
| CN | 1878010 | A | 12/2006 |
| CN | 1965495 | A | 5/2007 |

(Continued)

OTHER PUBLICATIONS

International Search Report, mailed Apr. 24, 2012, for International Application No. PCT/JP2012/000788, 2 pages.

*Primary Examiner* — Robert Karacsony
(74) *Attorney, Agent, or Firm* — Seed IP Law Group PLLC

(57) ABSTRACT

Both ends of a feeder and both ends of a reflector of an antenna device are connected using a pair of diodes. When the diodes are turned on, a loop antenna is formed which loops the feeder, the diode, the reflector, a capacitor, and the diode, and the antenna device operates as the loop antenna. When the diodes are turned off, the antenna device operates as a Yagi-Uda antenna which is formed of the feeder, the reflector, and a wave guide.

6 Claims, 8 Drawing Sheets

(56) References Cited

U.S. PATENT DOCUMENTS

| | | | | |
|---|---|---|---|---|
| 7,760,150 | B2 | 7/2010 | Sato | |
| 2006/0170599 | A1 | 8/2006 | Gilmore et al. | |
| 2007/0132591 | A1 | 6/2007 | Khatri | |
| 2007/0159404 | A1 | 7/2007 | Gilmore et al. | |
| 2007/0242785 | A1 | 10/2007 | Thudor et al. | |
| 2008/0231526 | A1 * | 9/2008 | Sato | 343/722 |
| 2011/0127081 | A1 | 6/2011 | van Dijk et al. | |

FOREIGN PATENT DOCUMENTS

| | | | |
|---|---|---|---|
| EP | 2 128 928 | A1 | 5/2008 |
| EP | 2 294 655 | A1 | 3/2011 |
| JP | 07-226624 | A | 8/1995 |
| JP | H10-084306 | A | 3/1998 |
| JP | 2006-005903 | A | 1/2006 |
| JP | 2007-159129 | A | 6/2007 |
| WO | 2009/145631 | A1 | 12/2009 |

* cited by examiner (A)

(B)

ANTENNA DEVICE

TECHNICAL FIELD

The present invention relates to an antenna device having directivity.

BACKGROUND ART

In recent years, users who send content stored in a stationary recording device to a portable terminal and enjoy the content outside, or users who exchange content with friends' portable terminals or send their own content to friends' portable terminals are increasing in number. In addition, the stationary recording device includes a PC and a recorder in households, and the content includes an image and a moving image, and the portable terminal includes a mobile phone.

A communication direction and a communication range of a portable terminal are different between a case in which a user puts own portable terminal and a friend's portable terminal closer to each other to communicate to exchange content, and a case in which a user communicates to send content to a distant television in a house using own portable terminal.

For example, for communicating with a nearby device, communication is made using radio waves for a short distance from a rear surface of a portable terminal. Meanwhile, for communicating with a distant device, communication is made using radio waves for long distances from a side surface of a portable terminal. As described above, the communication direction and the communication range are different depending on the usage purpose. The communication direction indicates a place of a communication terminal to which radio waves are transmitted.

A radiation pattern variable antenna or a sector antenna is used for switching the communication direction and the communication range. The sector antenna is an antenna in which a plurality of antennas having directivity are arranged so as to obtain directivity in every direction and one of antennas is selected and used to obtain a desired directivity. The radiation pattern variable antenna is an antenna in which directivity arbitrarily varies by controlling a phase of electric current fed to a plurality of antennas.

A technique disclosed in Patent Literature 1 has been known as a related art relating to such a radiation pattern variable antenna or a sector antenna. The sector antenna covers a broad communication range by switching a plurality of antennas having directivity in different directions, for example, four directions. In addition, the radiation pattern variable antenna freely changes overall antenna directivity by controlling a phase of electric current fed to a plurality of antennas and changing a direction in which radio waves emitted from a plurality of antenna elements are combined and offset each other.

CITATION LIST

Patent Literature

Patent Literature 1: JP-A-10-84306

SUMMARY OF INVENTION

Technical Problem

However, the antenna of the related art disclosed in Patent Literature 1 has the following problems. That is, for the sector antenna, a plurality of antennas having directivity in different directions from each other is used. The radiation pattern variable antenna needs to be provided with large numbers of elements configuring the antenna. Accordingly, a communication module including the antenna is necessary to be large in size.

In particular, in order to transmit and receive a millimeter wave in a frequency band, for example, 60 GHz using the radiation pattern variable antenna, a control circuit of the antenna elements is necessary to control each antenna element with high accuracy. Accordingly, electricity consumption of the control circuit becomes large.

The present invention has been made to address the aforementioned problems, and an object of the present invention is to provide an antenna device in which directivity of radio waves used for communication is easily switched depending on the usage purpose.

Solution to Problem

An antenna device according to the present invention includes a feeding conductor; a first conductor which is disposed at a predetermined distance from the feeding conductor; a second conductor which is disposed at a predetermined distance from the feeding conductor at an opposite side to the first conductor; and a plurality of connection elements which connect the second conductor and the feeding conductor, wherein the plurality of connection elements can be switched on and off, respectively.

Advantageous Effects of Invention

According to the present invention, it is possible to easily switch the directivity of the radio waves used for communication depending on the usage purpose.

DESCRIPTION OF EMBODIMENTS

Antenna devices according to respective embodiments of the present invention will be described with reference to the drawings. The antenna devices according to the embodiments are mounted on a portable terminal communicating using radio waves in a millimeter-wave band.

First Embodiment

Figure 1:
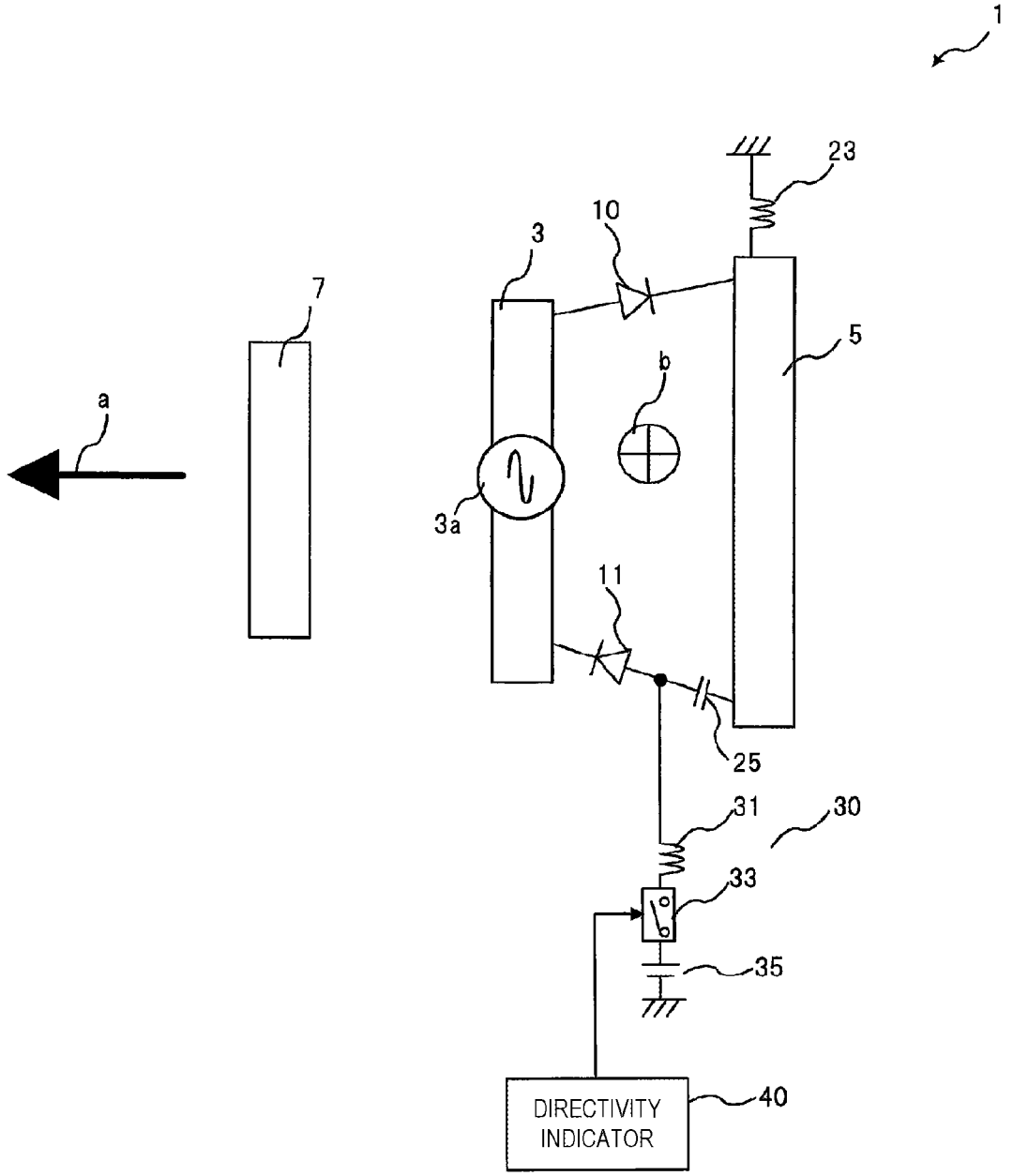
FIG. 1 is an explanatory view showing a configuration of an antenna device according to a first embodiment.

FIG. 1 is an explanatory view showing a configuration of an antenna device according to a first embodiment. An antenna device 1 is formed on a control board 53 (see FIG. 2) which is built in a portable terminal 50 (see FIG. 2).

The antenna 1 includes a feeder 3 as a feeding conductor, a reflector 5 as a second conductor disposed at a predetermined distance from the feeder 3, and a wave guide 7 as a first conductor disposed at a predetermined distance from the feeder 3 at the opposite side to the reflector 5.

The feeder 3 is a center-fed type ½ wavelength dipole antenna including a feeding point 3*a* of high frequency power (high frequency electric current) at the center, and has a line length slightly shorter than the length of ½ of the wavelength (resonant length λg) of radio waves of a communication frequency.

In addition, the feeder 3 includes the line length slightly shorter than the length of ½ of the wavelength (resonant length λg) of the radio waves of the communication frequency because of an effect of capacity of an open end of a line end, and an electrical length containing the capacity of the open end becomes ½.

The reflector 5 is a conductor for reflecting radio interference or noise components from the right side of FIG. 1, and is disposed at a distance by Distance D=0.07 λg from the feeder 3, for example, as an efficient distance in a case of being used as Yagi-Uda antenna.

Both ends of the feeder 3 and both ends of the reflector 5 are connected to each other using diodes 10 and 11 as a pair of PN junction elements, respectively. An anode side of the diode 10 is connected to one end of the feeder 3, and a cathode side of the diode 10 is connected to one end of the reflector 5. The end of the reflector connected to the cathode side of the diode 10 is grounded through a resistor 23.

A cathode side of the diode 11 is connected to another end of the feeder 3 and an anode side of the diode 11 is connected to another end of the reflector 5 through a capacitor 25.

By turning on the pair of diodes 10 and 11, a loop antenna is formed which loops the feeder 3, the diode 10, the reflector 5, the capacitor 25, and the diode 11. Accordingly, the antenna device 1 operates as a loop antenna, and has directivity of a radio wave in a vertical direction b to a plane of FIG. 1.

A length of the feeder 3 is set to be a line length which is shorter than a length of ½ of the resonant length λg by a predetermined amount because a length of the formed loop antenna is to be a length similar to 1 wavelength of the radio waves of the communication frequency.

By turning off the pair of diodes 10 and 11, the antenna device operates as Yagi-Uda antenna formed of the feeder 3, the reflector 5, and the wave guide 7, and has directivity of the radio waves in a space horizontal (left side) direction a of FIG. 1.

A bias circuit 30 is provided between the anode side of the diode 11 and the capacitor 25. The bias circuit 30 includes a switch 33 as a switching section which switches on and off a contact point connected to the anode side of the diode 11 through a resistor 31 and a contact point connected to a power supply 35.

By applying power supply voltage to the anode side of the diode 11 by turning on the switch 33, the bias circuit 30 can turn on the pair of diodes 10 and 11.

In addition, the switch 33 as the switching section is connected to a directivity indicator 40. The switch 33 is switched on or off according to a control signal from the directivity indicator 40.

The directivity indicator 40 is formed on the control board 53 (see FIG. 2) as a part of the antenna device 1, and generates a control signal which indicates directivity determined by an application executed in the portable terminal 50.

For example, an operation of a case in which a user holds (brings) the portable terminal 50 over a portable terminal 80 (see FIG. 3(*b*)) of a partner to transmit and receive data will be described. In order to switch to the loop antenna suitable for directivity determined by the application, the directivity indicator 40 outputs a control signal in a high level and turns on the switch 33.

Figure 2:
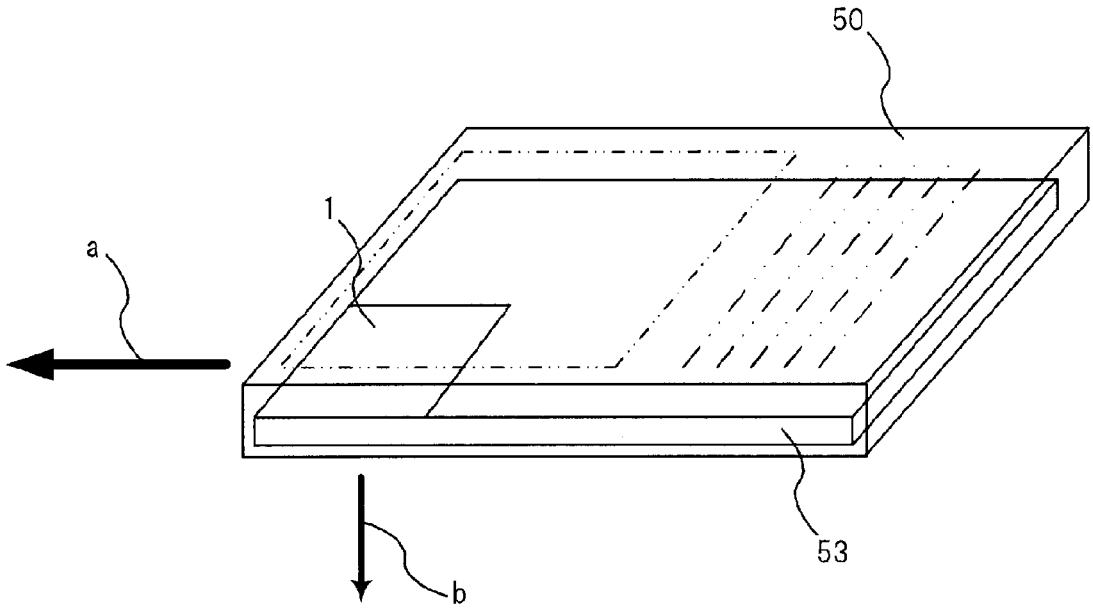
FIG. 2 is an explanatory view for illustrating a communication direction and a communication range of a portable terminal provided with a built-in control board on which an antenna device according to a first embodiment is mounted.

FIG. 2 is an explanatory view for illustrating a communication direction and a communication range of the portable terminal 50 provided with a built-in control board 53 on which the antenna device 1 according to the first embodiment is mounted. The antenna device 1 is formed in a planar shape on a rear side of the control board 53, as described above.

In a case of operating the Yagi-Uda antenna, as shown by reference numeral a of the figure, the antenna device 1 has strong directivity to set a direction (direction parallel with the control board 53) vertical with respect to the side surface of the portable terminal 50 to a communication direction, and enables communication for a longer distance than the communication range of the loop antenna.

In a case of operating as the loop antenna, as shown by a reference numeral b of the figure, the antenna device 1 has weak directivity to set a direction (direction vertical to the control board 53) vertical with respect to the rear surface of the portable terminal 50 to a communication direction, and enables communication for a shorter distance than the communication range of the Yagi-Uda antenna.

Figure 3:
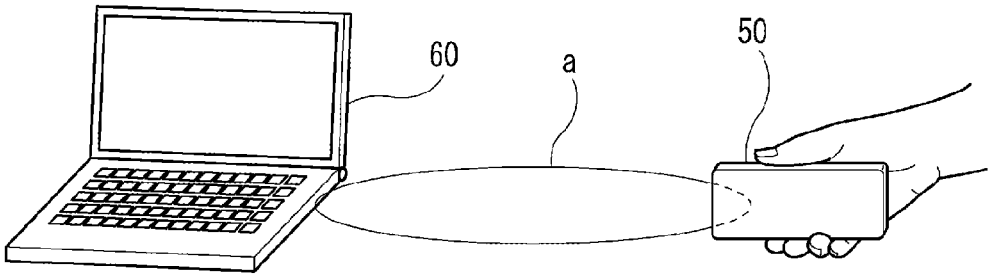
FIG. 3 is an explanatory view for illustrating usage examples of an antenna device according to a first embodiment depending on the usage purpose, in which (A) is a usage example of content downloading from a data communication device and (B) is a usage example of data exchange between portable terminals.
Figure 3:
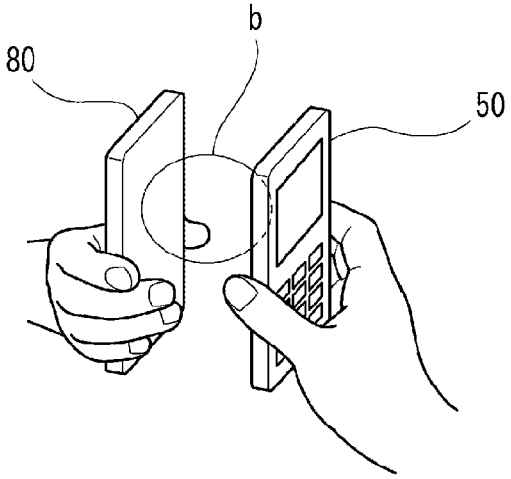

FIG. 3 is an explanatory view for illustrating usage examples of the antenna device 1 according to the first embodiment depending on the usage purpose. (A) of the figure is a usage example for downloading (transmitting) content from a data communication device 60. In order to download content from the data communication device 60 including a PDA (personal digital assistant), a note book type PC (personal computer) or a television, the portable terminal 50 communicates in distance longer than that of the loop antenna using radio waves having strong directivity.

The application executed in the portable terminal 50 determines that the antenna device 1 operates as the Yagi-Uda antenna, with respect to the directivity indicator 40 according to the download manipulation indication from a user. The directivity indicator 40 outputs a control signal in a low level to the switch 33.

When the control signal is received, the switch 33 remains to be turned off. Accordingly, the pair of diodes 10 and 11 stays to be turned off without applying voltage to the anode side of the diode 11. As a result, the antenna device 1 operates as the Yagi-Uda antenna.

In FIG. 3, (B) is a usage example of data exchange between the portable terminals (50 and 80). In order to exchange the data by bringing the rear surface of the user's own portable terminal 50 close to the partner's portable terminal 80, the portable terminal 50 communicates in a distance shorter than that of the Yagi-Uda antenna using radio waves having weak directivity.

The application executed in the portable terminal 50 determines that the antenna device 1 operates as the loop antenna, with respect to the directivity indicator 40 according to manipulation indication of data exchange from a user. The directivity indicator 40 outputs a control signal in a high level to the switch 33.

When the control signal is received, the switch 33 switches from turning off to turning on. Accordingly, the pair of diodes 10 and 11 turns on by applying voltage to the anode side of the diode 11. As a result, the antenna device 1 operates as the loop antenna.

In addition, FIGS. 3(A) and 3(B) are examples of the usage purposes of the portable terminal 50 including the antenna device 1, and switching of the directivity of radio waves of the antenna device 1 can be performed depending on various usage purposes.

As described above, according to the antenna device 1 according to the first embodiment, it is possible to easily switch directivity of radio waves used for communication depending on usage purposes. In addition, in order to operate as a plurality of antennas, it is possible to miniaturize the antenna device by sharing antenna elements.

Further, by using the antenna device 1 as the Yagi-Uda antenna or the loop antenna, it is possible to set a communication range necessary for the communication direction such as in the vertical direction or in the horizontal direction.

Second Embodiment

In the first embodiment, the bias circuit 30 is provided for switching on and off the pair of diodes 10 and 11, and directivity of radio waves is switched depending on the control signal from the directivity indicator 40. In a second embodiment, diodes switch on and off according to the strength of received radio waves without using the bias circuit 30 and the directivity indicator 40.

Figure 4:
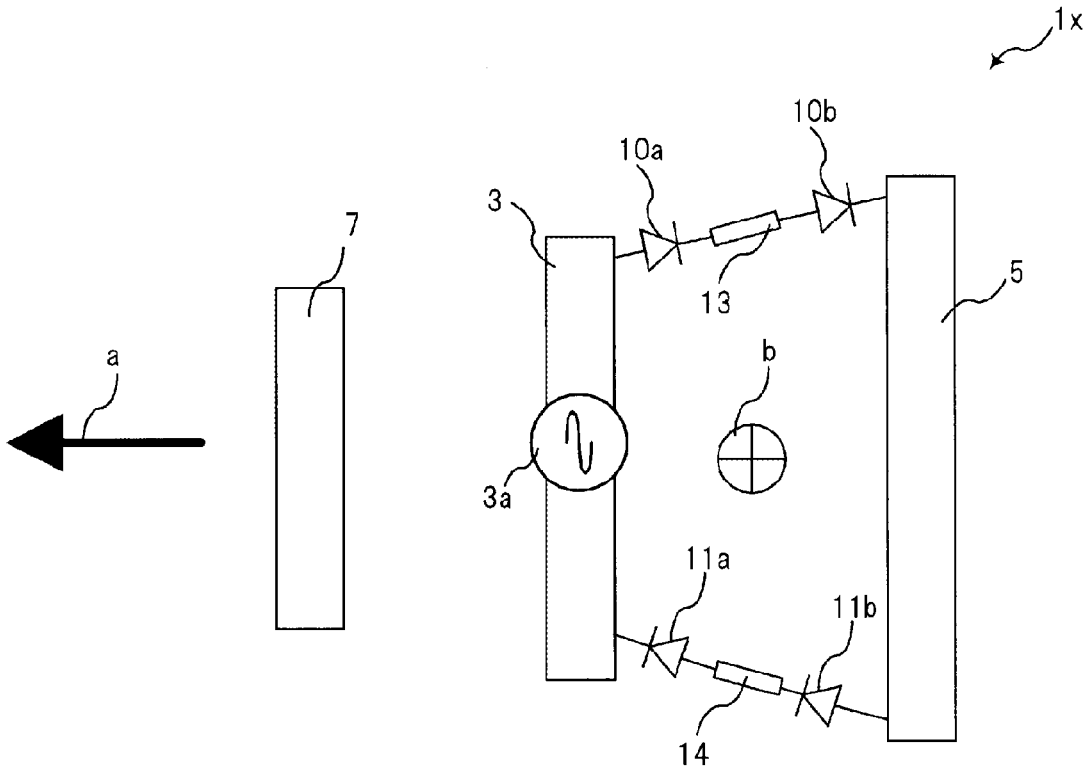
FIG. 4 is an explanatory view showing a configuration of an antenna device according to a second embodiment.

FIG. 4 shows a configuration of an antenna device 1*x* according to the second embodiment. In the same manner as the first embodiment, the antenna device 1*x* includes the feeder 3, the reflector 5, and the wave guide 7. In addition, the same constituent elements as the antenna device 1 according to the first embodiment are used with the same reference numerals, and the description thereof will be omitted.

Although the diode is connected to a line end, in a state in which the diode is turned off, the feeder 3 receives an effect of capacity of an open end of the line end. Accordingly, the feeder 3 has the line length slightly shorter than a length of ½ of the wavelength (resonant length λg) of the radio waves of the communication frequency. However, in a state in which the diode is turned on, the feeder 3 does not receive an effect of the capacity of the open end of the line end. Accordingly, a line for wavelength adjustment is used for the antenna device 1*x* to compensate for the short line length.

One end of the feeder 3 and one end of the reflector 5 are connected by a pair of diodes 10*a* and 10*b* and a line for wavelength adjustment 13 which is connected therebetween. In the same manner, another end of the feeder 3 and another end of the reflector 5 are connected by a pair of diodes 11*a* and 11*b* and a line for wavelength adjustment 14 which is connected therebetween.

The length of the lines for wavelength adjustment 13 and 14 are set so that a length obtained by adding the length of the feeder 3 and the length of the reflector 5 becomes 1 wavelength, in order to be matched with the frequency of radio waves received as the loop antenna. In the radio waves of the frequency band of a millimeter wave, since there is a great difference in radio wave gain according to the difference of extremely short length of a millimeter unit, it is important to provide lines for wavelength adjustment to approach 1 wavelength of radio waves.

For example, when the length of the loop antenna is 5.0 mm, if the length of the feeder 3 is set to be 2.0 mm and the length of the reflector 5 is set to be 2.5 mm, the lengths of the pair of lines for wavelength adjustment 13 and 14 become 0.25 mm, respectively. Accordingly, it is necessary that the line length obtained by adding the lengths of the feeder 3, the reflector 4, and the pair of lines of wavelength adjustments 13 and 14 match to a desired line length of the loop antenna.

In addition, the lengths of the pairs of lines of wavelength adjustments 13 and 14 are not necessary to be same, and it is acceptable as long as the total length thereof is 0.5 mm.

Figure 5:
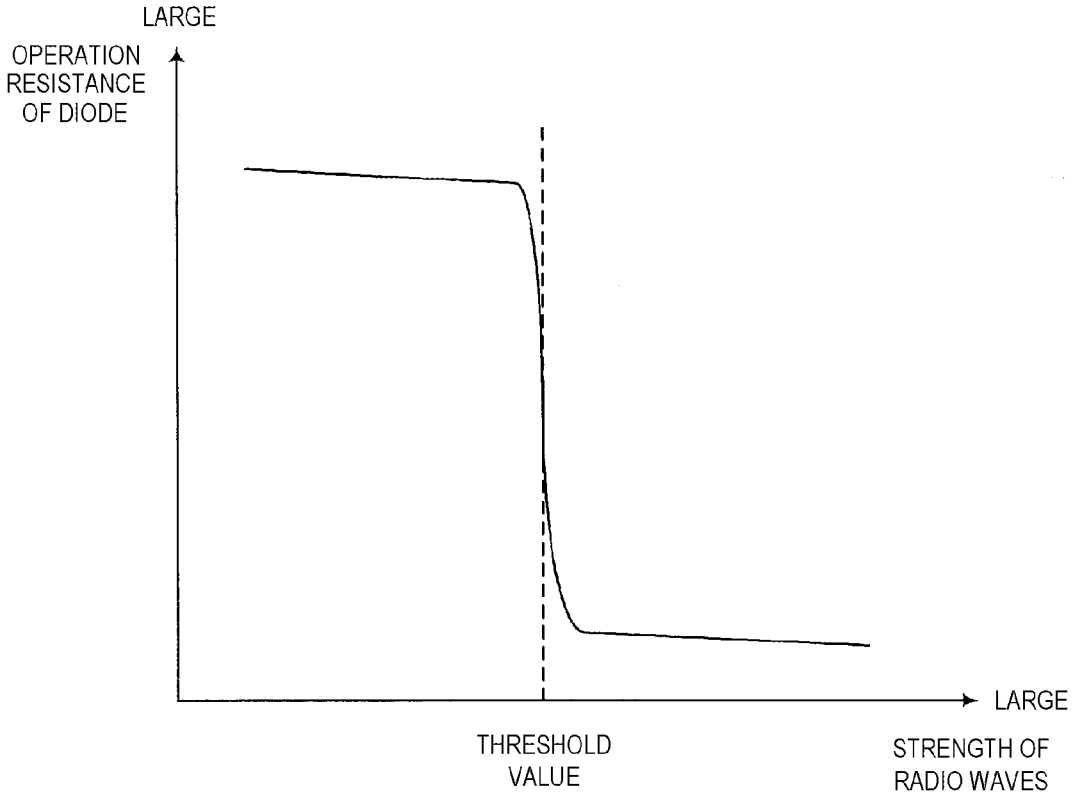
FIG. 5 is a graph showing an operation of turning on and off of diode with respect to the strength of syntonized received radio waves.

In the second embodiment, the diodes 10*a*, 10*b*, 11*a*, and 11*b* are turned on and off according to the strength of the received radio waves syntonized to the loop antenna. FIG. 5 is a graph showing an operation of turning on and off the diode with respect to the strength of syntonized received radio waves. The vertical axis indicates operation resistance of the diode and the horizontal axis indicates the strength of radio waves.

The diode is a PN junction element which flows out electric current if a predetermined value or more of bias voltage (positive voltage to p type side) is added to a forward direction. Accordingly, if the strength of the syntonized radio waves approaches a certain threshold value, the voltage to be applied to both ends of the diode becomes great, the diode is turned on, and the operation resistance is significantly decreased.

Accordingly, a loop antenna formed of the feeder 3, the pair of diodes 10*a* and 10*b*, the line for wavelength adjustment 13, the reflector 5, the pair of diodes 11*a* and 11*b*, and the line for wavelength adjustment 14 is formed. In addition, it is desirable to match characteristics of turning on and off of four diodes 10*a*, 10*b*, 11*a*, and lib with each other.

For the usage purpose, in order to communicate by holding the rear surface of the portable terminal 50 over a partner's portable terminal or various scanning devices which is in a short distance, the portable terminal 50 communicates using radio waves having weak directivity and a stronger strength than the Yagi-Uda antenna. In a case of strong strength of the radio waves, all diodes 10*a*, 10*b*, 11*a*, and 11*b* are turned on, and the antenna device 1*x* operates as the loop antenna.

Meanwhile, in order to exchange the content with a data communication device in a long distance, the portable terminal 50 communicates using radio waves having strong directivity and weaker strength than the loop antenna. In a case of weak strength of the radio waves, all diodes 10*a*, 10*b*, 11*a*, and 11*b* are turned off, and the antenna device 1*x* operates as the Yagi-Uda antenna.

According to the antenna device 1*x* according to the second embodiment, it is possible to switch on and off the diode depending on the strength of syntonized radio waves, and to easily switch directivity of the radio waves used for communication according to the usage purpose. In addition, it is possible to miniaturize the antenna device without providing the bias circuit.

In addition, in the second embodiment, the pair of lines for wavelength adjustment are provided at both ends of the feed and the reflector, respectively, however, the line for wavelength adjustment may be provided at only one side thereof. It is preferable that the length of the line for wavelength adjustment provided only at one side be matched to the same length obtained by adding the lengths of the pair of lines for wavelength adjustment.

In addition, in the second embodiment, the antenna device 1*x* with which the bias circuit and the directivity indicator are not provided, which is different from the first embodiment has been described. However, in the same manner as the first embodiment, the antenna device 1*x* according to the second embodiment may be provided with the bias circuit and the directivity indicator.

Third Embodiment

In the first and second embodiments, the configuration of switching the connection of the feeder 3 and the reflector 5 by turning on and off the diode has been described. In a third embodiment, a configuration of switching the connection of the feeder and the wave guide by turning on and off the diode will be described.

Figure 6:
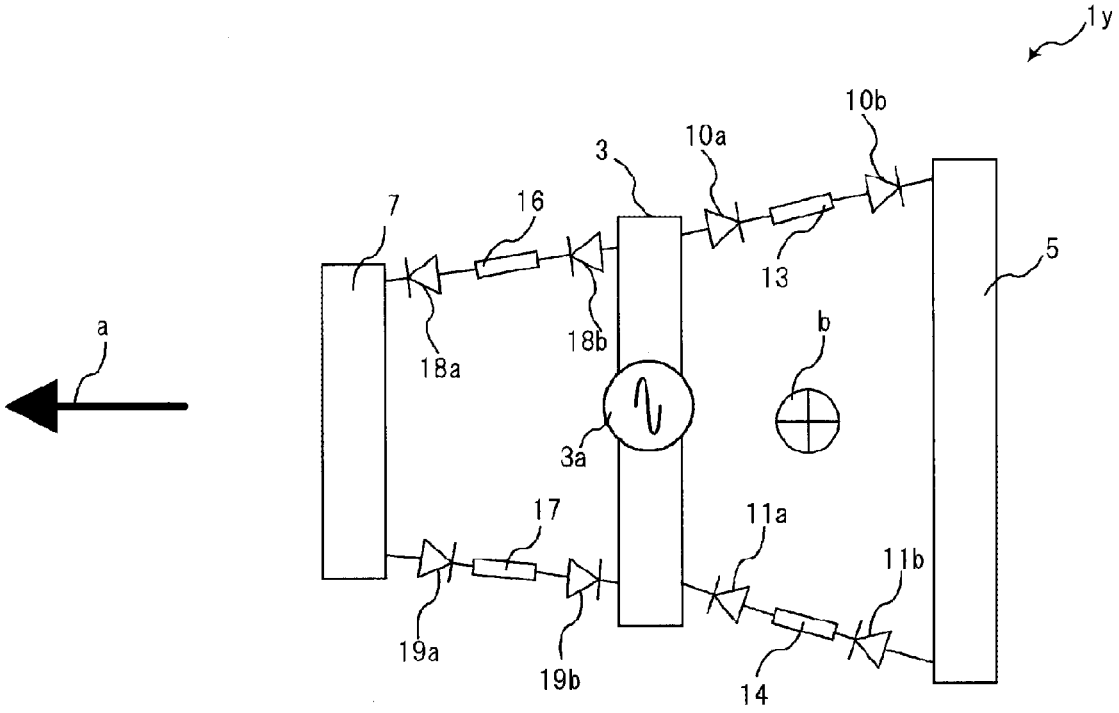
FIG. 6 is an explanatory view schematically showing a configuration of an antenna device according to a third embodiment.

FIG. 6 shows a configuration of an antenna device 1*y* according to the third embodiment. In the same manner as the antenna device 1 according to the first embodiment, the antenna device 1*y* includes the feeder 3, the reflector 5, and the wave guide 7. In addition, the same constituent elements as the antenna devices 1 and 1*x* of the first and second embodiments are used with the same reference numerals, and the description thereof will be omitted.

As also shown in the second embodiment, one end of the feeder 3 and one end of the reflector 5 are connected using the pair of diodes 10*a* and 10*b* which interpose the line for wavelength adjustment 13. In the same manner, another end of the feeder 3 and another end of the reflector 5 are connected using the pair of diodes 11*a* and 11*b* which include the line for wavelength adjustment 14.

When the diodes 10*a*, 10*b*, 11*a*, and 11*b* are turned on, a loop antenna including the feeder 3, the reflector 5, and the pair of lines for wavelength adjustments 13 and 14 is formed. High frequency power (high frequency electric current) is fed so that a length obtained by adding the length of the feeder 3, the length of the reflector 5, and the lengths of the pair of lines of wavelength adjustments 13 and 14 becomes 1 wavelength.

Further, one end of the feeder 3 and one end of the wave guide 7 are connected using a pair of diodes 18*a* and 18*b* and a line for wavelength adjustment 16 as a second line for wavelength adjustment which is connected therebetween. In the same manner, another end of the feeder 3 and another end of the wave guide 7 are connected using a pair of diodes 19*a* and 19*b* and a line for wavelength adjustment 17 as a second line for wavelength adjustment which is connected therebetween.

If the diodes 18*a*, 18*b*, 19*a*, and 19*b* as a plurality of second connection elements are turned on, a loop antenna formed of the feeder 3, the wave guide 7, and the pair of lines for wavelength adjustments 16 and 17 is formed.

High frequency power (high frequency electric current) which generates radio waves (second radio waves) of a communication frequency which is different from the loop antenna on the reflector 5 side is fed so that a length obtained by adding the length of the feeder 3, the length of the wave guide 7, and the lengths of the pair of lines of wavelength adjustments 16 and 17 becomes 1 wavelength.

For example, if the frequency of the radio waves generated based on the power feeding of the feeder 3 as the ½ wavelength dipole antenna is 60 GHz, the frequency of the radio waves generated based on the power feeding of the loop antenna including the reflector 5 is set to 58 GHz.

In addition, in the loop antenna including the wave guide 7, since the length thereof is shorter than the length of the loop antenna including the reflector 5, the frequency of the radio waves generated based on the power feeding of the loop antenna including the wave guide 7 is set to 62 GHz. By using two loop antennas while switching to each other, it is possible to generate radio waves having different frequency bands (channel) by the power feeding.

According to the antenna device 1*y* according to the third embodiment, it is possible to perform operation as a loop antenna syntonized to the radio waves with two different channels. In addition, in order to be used as the Yagi-Uda antenna, two or more wave guides may be provided to obtain a high directivity. It is possible to form a loop antenna by interposing lines for wavelength adjustment which have different lengths for each wave guide, and to feed radio waves with larger numbers of channels.

In addition, the present invention is not limited to the configuration of the embodiments, and modifications can be applied as long as it has a configuration to realize functions shown in claims or functions included in the configuration of the embodiments.

For example, in the second and third embodiments, the diodes are switched on and off depending on the strength of the syntonized radio waves. Alternatively, in the same manner as the first embodiment, the bias circuit and the directivity indicator may be provided to switch the diodes on and off on the reflector side and the wave guide side. In addition, the switching according to the strength of the radio waves, and the switching by the bias circuit and the directivity indicator may be mixed.

Figure 7:
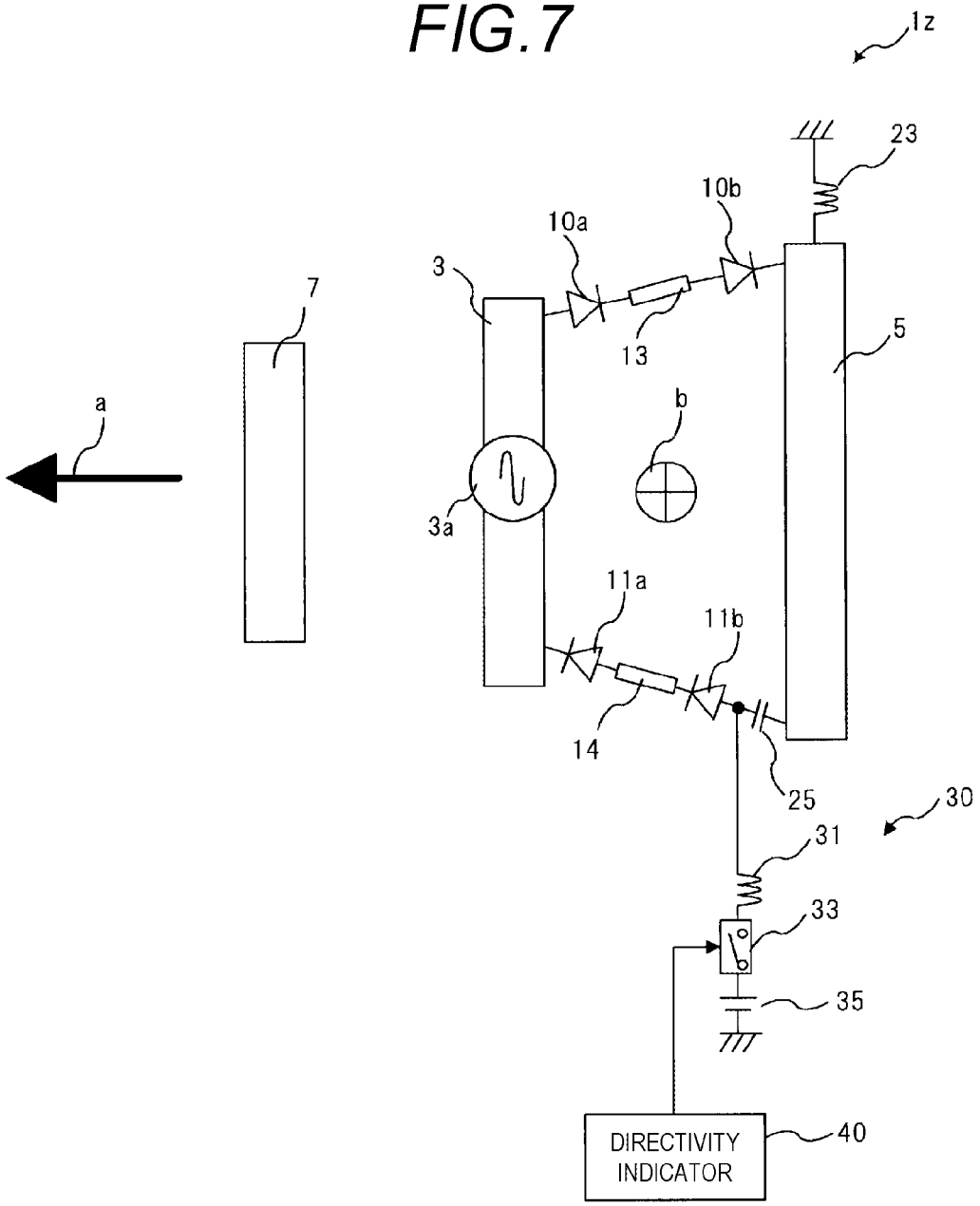
FIG. 7 is an explanatory view showing a configuration of an antenna device of a modification example according to a second embodiment.

FIG. 7 is an explanatory view showing a configuration of an antenna device 1*z* according to a modification example of the second embodiment. The antenna device 1*z* further includes the bias circuit 30 and the directivity indicator 40 which are same as in the antenna device according to the first embodiment, in addition to the configuration of the antenna device 1*x* according to the second embodiment.

One end of the feeder 3 and one end of the reflector 5 are connected by the pair of diodes 10*a* and 10*b* and the line for wavelength adjustment 13 which is connected therebetween. In the same manner, another end of the feeder 3 and another end of the reflector 5 are connected by the pair of diodes 11*a* and 11*b* and the line for wavelength adjustment 14 which is connected therebetween.

The anode side of the diode 10*a* is connected to one end of the feeder 3, and the cathode side of the diode 10*a* is connected to the anode side of the diode 10*b* through the line for wavelength adjustment 13. The cathode side of the diode 10*b* is connected to one end of the reflector 5. One end of the reflector 5 connected to the cathode side of the diode 10*b* is grounded through the resistor 23.

The cathode side of the diode 11*a* is connected to another end of the feeder 3, and the anode side of the diode 11*a* is connected to the cathode side of the diode 11*b* through the line for wavelength adjustment 14. The anode side of the diode 11*b* is connected to another end of the reflector 5 through the capacitor 25.

By turning on the diodes 10*a*, 10*b*, 11*a*, and 11*b*, a loop antenna which loops the feeder 3, the diodes 10*a* and 10*b*, the reflector 5, the capacitor 25, and the diodes 11*b* an 11*a* is formed. Accordingly, the antenna device 1*z* operates as the loop antenna, and has directivity of the radio waves in a vertical direction b to a space of FIG. 7.

The bias circuit 30 is provided between the anode side of the diode 11*b* and the capacitor 25. The bias circuit 30 includes the switch 33 as a switching section which switches on and off a contact point connected to the anode side of the diode 11*b* through the resistor 31 and a contact point connected to the power supply 35.

By applying power supply voltage to the anode side of the diode 11*b* by turning on the switch 33, the bias circuit 30 can turn on the diodes 10*a*, 10*b*, 11*a* and 11*b*.

In addition, the switch 33 as the switching section is connected to the directivity indicator 40. The switch 33 is switched on or off according to a control signal from the directivity indicator 40.

The directivity indicator 40 is formed on the control board 53 (see FIG. 2) as a part of the antenna device 1*z*, and generates a control signal which indicates directivity determined by an application executed in the portable terminal 50.

In the same manner as the antenna device 1 shown in FIG. 1, the antenna device 1*z* shown in FIG. 7 switches on and off the diodes 10*a*, 10*b*, 11*a*, and 11*b* between the feeder 3 and the reflector 5 using the bias circuit 30 and the directivity indicator 40. In addition, the antenna device 1*z* may switch on and off the diodes 10*a*, 10*b*, 11*a*, and 11*b* between the feeder 3 and the reflector 5 using the bias circuit 30, the directivity indicator 40, and the strength of the syntonized radio waves.

Figure 8:
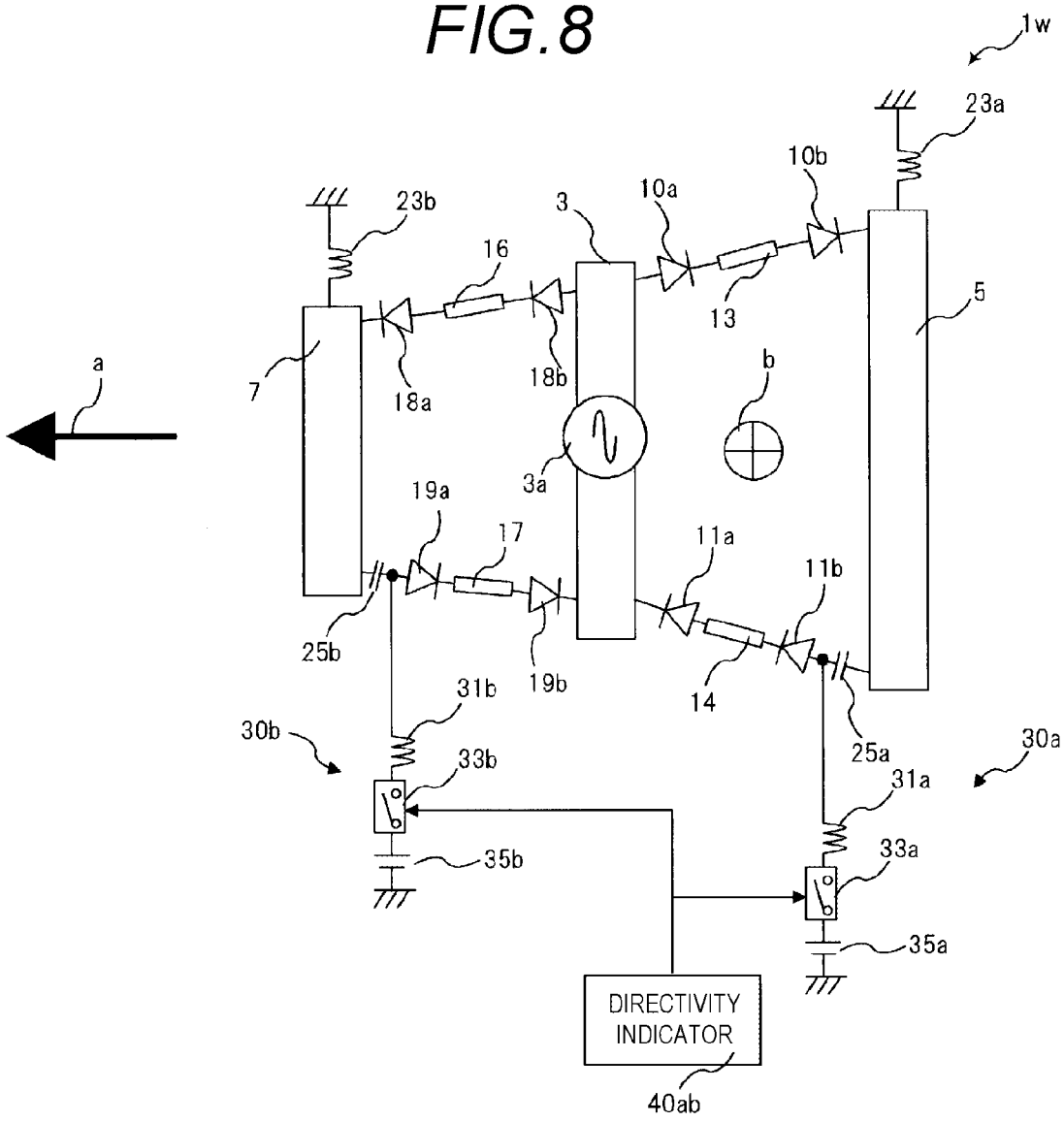
FIG. 8 is an explanatory view showing a configuration of an antenna device of a modification example according to a third embodiment.

FIG. 8 is an explanatory view showing a configuration of an antenna device 1*w* according to a modification example of the third embodiment. The antenna device 1*w* further includes bias circuit 30*a* and 30*b* and directivity indicator 40*ab* which are same as the antenna device according to the first embodiment, in addition to the configuration of the antenna device 1*y* according to the third embodiment.

One end of the feeder 3 and one end of the reflector 5 are connected by the pair of diodes 10*a* and 10*b* and the line for wavelength adjustment 13 which is connected therebetween. In the same manner, another end of the feeder 3 and another end of the reflector 5 are connected by the pair of diodes 11*a* and 11*b* and the line for wavelength adjustment 14 which is connected therebetween.

The anode side of the diode 10*a* is connected to one end of the feeder 3, and the cathode side of the diode 10*a* is connected to the anode side of the diode 10*b* through the line for wavelength adjustment 13. The cathode side of the diode 10*b* is connected to one end of the reflector 5. One end of the reflector 5 connected to the cathode side of the diode 10*b* is grounded through the resistor 23.

The cathode side of the diode 11*a* is connected to another end of the feeder 3, and the anode side of the diode 11*a* is connected to the cathode side of the diode 11*b* through the line for wavelength adjustment 14. The anode side of the diode 11*b* is connected to another end of the reflector 5 through a capacitor 25*a*.

By turning on the diodes 10*a*, 10*b*, 11*a*, and 11*b*, a loop antenna which loops the feeder 3, the diodes 10*a* and 10*b*, the reflector 5, the capacitor 25*a*, and the diodes 11*b* an 11*a* is formed. Accordingly, the antenna device 1*w* operates as the loop antenna, and has directivity of the radio waves in a vertical direction b to a space of FIG. 8.

The bias circuit 30*a* is provided between the anode side of the diode 11*b* and the capacitor 25*a*. The bias circuit 30*a* includes a switch 33*a* as a switching section which switches on and off a contact point connected to the anode side of the diode 11*b* through the resistor 31*a* and a contact point connected to a power supply 35*a*.

By applying power supply voltage to the anode side of the diode 11*b* by turning on the switch 33*a*, the bias circuit 30*a* can turn on the diodes 10*a*, 10*b*, 11*a* and 11*b*.

In addition, the switch 33*a* as the switching section is connected to the directivity indicator 40*ab*. The switch 33*a* is switched on or off according to a control signal from the directivity indicator 40*ab*.

One end of the feeder 3 and one end of the wave guide 7 are connected using the pair of diodes 18*a* and 18*b* and the line for wavelength adjustment 16 which is connected therebetween. In the same manner, another end of the feeder 3 and another end of the wave guide 7 are connected using the pair of diodes 19*a* and 19*b* and the line for wavelength adjustment 17 which is connected therebetween.

The anode side of the diode 18*b* is connected to one end of the feeder 3, and the cathode side of the diode 18*b* is connected to the anode side of the diode 18*a* through the line for wavelength adjustment 16. The cathode side of the diode 18*a* is connected to one end of the wave guide 7. One end of the wave guide 7 connected to the cathode side of the diode 18*a* is grounded through a resistor 23*b*.

The cathode side of the diode 19*b* is connected to another end of the feeder 3, and the anode side of the diode 19*b* is connected to the cathode side of the diode 19*a* through the line for wavelength adjustment 17. The anode side of the diode 19*a* is connected to another end of the wave guide 7 through a capacitor 25*b*.

By turning on the diodes 18*a*, 18*b*, 19*a*, and 19*b*, a loop antenna which loops the feeder 3, the diodes 18*a* and 18*b*, the wave guide 7, the capacitor 25*b*, and the diodes 19*b* an 19*a* is formed. Accordingly, the antenna device 1*w* operates as the loop antenna, and has directivity of the radio waves in a vertical direction b to a space of FIG. 8.

The bias circuit 30*b* is provided between the anode side of the diode 19*a* and the capacitor 25*b*. The bias circuit 30*b* includes a switch 33*b* as a switching section which switches on and off a contact point connected to the anode side of the diode 19*a* through the resistor 31*b* and a contact point connected to a power supply 35*b*.

By applying power supply voltage to the anode side of the diode 19*a* by turning on the switch 33*b*, the bias circuit 30*b* can turn on the diodes 18*a*, 18*b*, 19*a* and 19*b*.

In addition, the switch 33*b* as the switching section is connected to the directivity indicator 40*ab*. The switch 33*b* is switched on or off according to a control signal from the directivity indicator 40*ab*.

The directivity indicator 40*ab* is formed on the control board 53 (see FIG. 2) as a part of the antenna device 1*w*, and generates a control signal which indicates directivity determined by an application executed in the portable terminal 50.

In the same manner as the antenna device 1 shown in FIG. 1, the antenna device 1*w* shown in FIG. 8 switches on and off the diodes 10*a*, 10*b*, 11*a*, and 11*b* between the feeder 3 and the reflector 5 using the bias circuit 30*a* and the directivity indicator 40*ab*. In addition, the antenna device 1*w* may switch on and off the diodes 10*a*, 10*b*, 11*a*, and 11*b* between the feeder 3 and the reflector 5 using the bias circuit 30*a*, the directivity indicator 40*ab*, and the strength of the syntonized radio waves.

In addition, in the second and third embodiments, the lines for wavelength adjustment are provided so as to obtain 1 wavelength of the radio waves of the communication frequency, however, in a case where the frequency is different from the frequency in which the gain is the maximum value is acceptable, as shown in the first embodiment, the lines for wavelength adjustment can be omitted. In addition, the lines for wavelength adjustment may be provided in the antenna device according to the first embodiment.

Further, in the embodiments described above, the transmission and the reception of the radio waves in millimeter-wave bands (30 GHz to 300 GHz) have been described. Alternatively, the present invention can be applied in the same manner to transmission and reception of radio waves of other frequency bands including centimeter wave bands (3 GHz to 30 GHz).

In addition, in the embodiments described above, the diode is used for the connection device which functions as a switch. Alternatively, it is not limited thereto, and a semiconductor switch (FET switch) and another device including a minute mechanical switch may be used.

The present application is based on Japanese Patent Application No. 2011-027721 filed on Feb. 10, 2011, contents of which are incorporated herein by reference.

INDUSTRIAL APPLICABILITY

In the antenna device having directivity of the present invention is advantageous since it is possible to easily switch the directivity of the radio waves using the communication according to the usage purposes.

REFERENCE SIGNS LIST

1: Antenna device
3: Feeder
3*a*: Feeding point
5: Reflector
7: Wave guide
10, 10*a*, 10*b*, 11*a*, 11*b*, 18*a*, 18*b*, 19*a*, 19*b*: Diode
13, 14, 16, 17: Line for wavelength adjustment
23, 23*a*, 23*b*, 31: Resistor
25, 25*a*, 25*b*: Capacitor
30, 30*a*, 30*b*: Bias circuit
33, 33*a*, 33*b*: Switch
35, 35*a*, 35*b*: Power supply
40, 40*ab*: Directivity indicator
50, 80: Portable terminal
53: Control board
60: Data communication device

The invention claimed is:

1. An antenna device, comprising:
a feeding conductor;
a first conductor which is disposed at a predetermined distance from the feeding conductor;
a second conductor which is disposed at a predetermined distance from the feeding conductor at an opposite side to the first conductor; and
a plurality of connection elements which connect the second conductor and the feeding conductor, wherein the plurality of connection elements can be switched on and off, respectively, and
wherein each of the plurality of connection elements is turned on when a strength of a received radio wave is larger than a predetermined threshold value, and turned off when the strength of the received radio wave is smaller than the threshold value.

2. The antenna device according to claim 1, further comprising:
a directivity indicator which outputs a signal indicating directivity of radio waves; and
a switching section which switches on and off the plurality of connection elements according to the signal output from the directivity indicator.

3. The antenna device according to claim 1, wherein
the connection elements are PN junction elements.

4. The antenna device according to claim 1, wherein
a length of the feeding conductor is shorter than half of a wavelength of a radio wave for communication frequency by a predetermined amount.

5. The antenna device according to claim 4, further comprising:
a line for wavelength adjustment which is connected between a pair of the connection elements, and having a length, obtained by adding lengths of the feeding conductor and the second conductor, of a value close to 1 wavelength of the radio wave.

6. The antenna device according to claim 5, further comprising:
a plurality of second connection elements which connect the first conductor and the feeding conductor; and
a second line for wavelength adjustment which is connected between a pair of the second connection elements, and having a length, obtained by adding lengths of the feeding conductor and the first conductor, of a value close to 1 wavelength of second radio wave which has different frequency from the radio wave, wherein
the plurality of second connection elements can be switched on and off, respectively.

* * * * *